United States Patent [19]

Skidmore

[11] 3,955,635

[45] May 11, 1976

[54] PERCUSSION DRILL BIT

[76] Inventor: Sam C. Skidmore, 1513 Azteca Drive, Fort Worth, Tex. 76112

[22] Filed: Feb. 3, 1975

[21] Appl. No.: 546,508

[52] U.S. Cl. ..... 175/400; 175/410; 175/418

[51] Int. Cl.[2] ..... E21C 13/01

[58] Field of Search ..... 175/398, 400, 399, 417, 175/418, 400, 410, 395

[56] References Cited

UNITED STATES PATENTS

| | | | |
|---|---|---|---|
| 2,558,415 | 6/1951 | Bonsall | 175/400 X |
| 2,838,286 | 6/1958 | Austin | 175/330 |
| 3,269,470 | 8/1966 | Kelly | 175/410 |
| 3,357,507 | 12/1967 | Stewart | 175/418 X |
| 3,388,756 | 6/1968 | Varel et al. | 175/418 X |
| 3,583,504 | 6/1971 | Aalund | 175/410 X |
| 3,608,654 | 9/1971 | Powell | 175/418 X |
| 3,693,736 | 9/1972 | Gardner | 175/410 |
| 3,788,409 | 1/1974 | Curington | 175/418 X |

*Primary Examiner*—Frank L. Abbott
*Assistant Examiner*—Richard E. Favreau
*Attorney, Agent, or Firm*—Charles W. McHugh

[57] ABSTRACT

A substantially solid drill bit has a relatively flat face at its forward end; the face comprises a plurality of plateaus, preferably three in number, which are separated by radial relief channels that intersect one another near the center of the face. The sides of the body constitute a frustrum of a cone, preferably having an included angle of about 14°, with the narrow portion of the cone being at the base of the body. Spiral grooves extend along the sides of the body, and at least some of these spiral grooves intersect the radial relief channels. A plurality of hardened inserts or buttons are mounted on the face of the bit, and the radial spacing of such inserts from the longitudinal axis of the body is such that there is an overlap of the "track" or "trace" of each insert by the track of another insert, as the body is rotated about its longitudinal axis. Preferably, each plateau (or lobe) and its associated hardened inserts is different from the others; and there should be a substantial distance between at least some of the hardened inserts, in order to foster the fragmentation of relatively large rock chips. The bit is provided with a base or anvil which is adapted to receive percussive blows from a percussion hammer. Also, splines or the like are typically provided somewhere on the bit so that it may be rotated as well as driven forward. A plurality of flow passages extend through the body of the drill bit to permit the delivery of a drilling fluid to the face of the bit.

8 Claims, 7 Drawing Figures

PERCUSSION DRILL BIT

This invention relates generally to drill bits, and more particularly to a substantially solid drill bit which is adapted for percussion drilling in rock and other hard formations.

In recent years there has been developed equipment for drilling in the earth's crust which is particularly characterized by the percussive action of a drill bit as it hammers or beats against a rock formation. Exemplary of drill bits which are useful with such percussion equipment include the bit shown in U.S. Pat. 3,583,504 to Aalund. The drill bit of this invention may be considered to be of the same general type as that disclosed by Aalund, at least to the extent of the percussive nature of its operation. The bit of this invention, however, is particularly noteworthy in that it is extremely efficient at knocking loose and then removing from a hole relatively large chunks of hard material. Such chunks typically are knocked from a rock formation by downwardly facing protrusions or inserts (e.g., carbide inserts) which are provided on the face of a percussion drill bit. While it might be generally said that all percussion bits employ substantially the same type of hammer action, the drill bit of this invention appears to have an increased efficiency in promptly removing those chips that are knocked loose—so that such chips are not subsequently struck repetitive blows by the bit and converted into smaller chips. That is, this drill bit has a configuration which is conducive to knocking loose large chunks of rock in the bottom of the hole, and then quickly removing those chunks before they are broken into smaller chips by subsequent blows. The result of this is there is less wear on a bit to achieve a given hole depth because—for one reason—the hole is drilled faster and the bit is actually working in the hole for a shorter period of time. The advantage of increased speed in drilling a hole is, of course, of obvious benefit since a given amount of work can be accomplished at a lower cost—when one considers the expense of labor and the time that capital equipment is in use.

In brief, the invention comprises a substantially solid drill bit having a relatively flat face, such that it could be aptly described as a flat-head drill bit. The center of the face of the bit is recessed below its periphery, such that the bit can also be aptly described having a drop-center configuration. Along the sides of the bit are provided spiral grooves that extend from the front face of the bit to its base or rear face. Preferably, some of these grooves are larger than other grooves, such that the major grooves will remove large chips and the minor grooves can remove smaller cuttings. Certain radial channels are provided in the face of the bit, and these channels intersect the major spiral grooves, such that a chip that is created in front of the bit is rather quickly expelled to the rear thereof through the cooperative effort of a drilling fluid and the channels and grooves. Enough hardened inserts are provided on the face in locations such that the track of a given insert—as the bit is rotated about its longitudinal axis—is overlapped by the track of another insert. A plurality of flow passages extend through the body of the drill bit to permit the delivery of a drilling fluid to the face of the bit. In the drawings:

Figure 1:
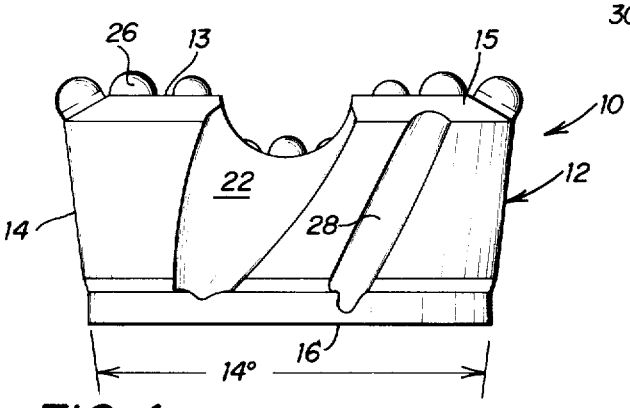
FIG. 1 is an elevation view of the drill bit taken from one side.

Referring initially to FIG. 1, the drill bit 10 comprises a substantially solid body 12 have a relatively flat face 13 at its forward end. The "corner" or edge where the face 13 intersects a generally cylindrical side wall 14 is preferably machined to provide an inclined surface 15 which makes an angle of about 30° with respect to a transverse plane across the face of the bit. In fact, the entire body 12 may be machined from bar stock, or it may be forged; it has been found, though, that greater accuracy in the placement of the various features (such as hardened inserts) is made possible when the bit is totally machined. The body 12 might also be described as being generally cylindrical, although there is a valid reason for wanting to avoid straight sides: namely, that a truly cylindrical body will usually be prone to let cuttings become wedged between the sides of the bit and the sides of the hole that is being drilled. Of course, the plural expression "sides" is used herein from time to time, even though it will be recognized that technically there is only one continuous side which extends 360° around the bit. The sides of the body 12 are preferably tapered inwardly from the face 13 toward the bit's base 16, such that the sides actually constitute a frustrum of a cone. In an optimum embodiment, this cone has an included angle of about 14°, i.e., there is approximately a 7° taper on each side of the body. Another way of describing this parameter is to say that the body 12 has a 7° positive relief along its sides. Since the narrow portion of the cone is at the base 16, there will be less tendency for the bit to become wedged in a hole as new cuttings are being forced upward past the base.

Figure 2:
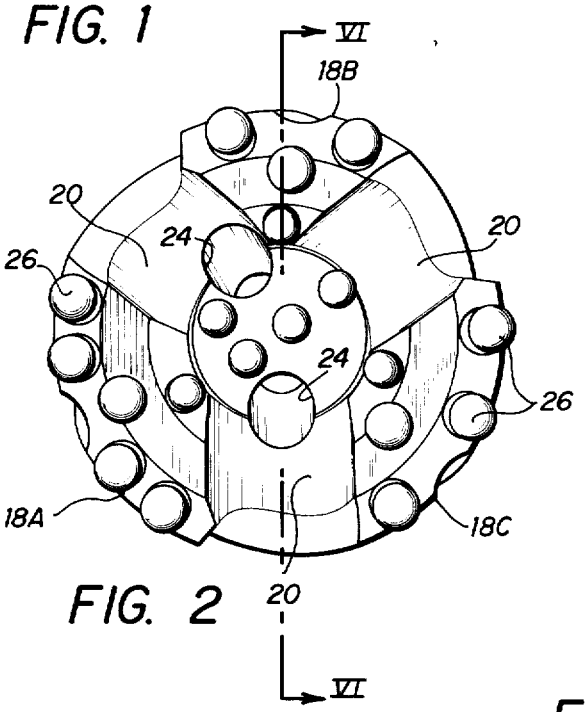
FIG. 2 is a top view of the drill bit shown in FIG. 1.

With additional reference to FIG. 2, the face 13 has a plurality of plateaus 18 which are separated by radial relief channels 20 that intersect one another at (or at least near) the center of the face. The outer ends of said relief channels 20 in turn intersect spiral grooves 22 (hereinafter referred to as major grooves) which extend along the sides of the bit 10. When the channels 20 are cylindrical, the diameter of the cylinder that defines said channels will usually be about ⅓ of the diameter of the bit, with a somewhat smaller fraction perhaps being adequate for bits having a diameter in excess of 8 inches. The cross-sectional area of said relief channels 20 are preferably about the same as the cross-sectional area of the major grooves at the face, so that the grooves will not tend to throttle or hold back any cuttings that may be expelled through the relief channels. Since the base 16 is more narrow than the forward end of the bit 10, there is inherently more clearance between the base 16 and the sides of the hole in which the body is working; hence, the actual cross-sectional area of a major groove need not be constant, and it could be somewhat less toward the base of the bit without introducing any deleterious choking. The face 13 of said body further has a center portion 23 which is recessed with respect to the plateau portions 18. This recessed center 23, which is conveniently referred to as a "drop center", serves to foster the drilling of a generally straight hole, since the small protuberance which is left in the center of the rock face tends to keep the drill bit centered as it hammers at the rock. The diameter of this dropped center 23 is preferably on the order of ¼ of the face diameter. The plateaus, therefore, will comprise about 50% of the face area of the bit.

A plurality of flow passages extend through the body 12 for the delivery of a drilling fluid to the face 13, and said passages terminate on the face at apertures 24 which lie either within a relief channel or the recessed center 23. As long as the fluid can operate to flush out the bottom of the hole and keep new cuttings moving backward away from the bit, it is not really critical as to where these apertures 24 are placed on the face 13.

Figure 3:
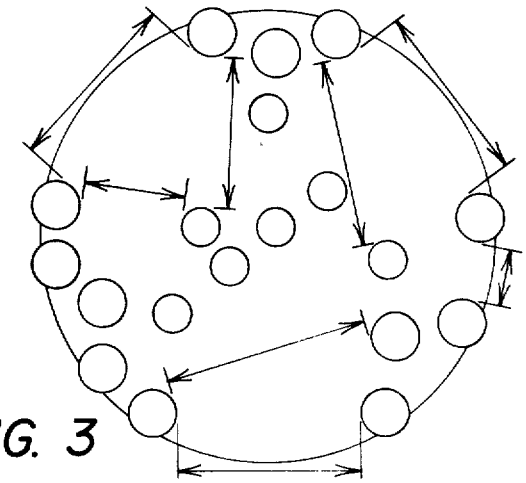
FIG. 3 is a diagramatic illustration of the face of a typical bit and showing exemplary gaps between spaced hardened inserts or buttons.

A plurality of hardened inserts 26, e.g., metallic carbide inserts, are distributed across the face of the bit 10, where they serve to bear against the rock face with each axial blow of the bit. At least some of said inserts 26 are distributed around the periphery of the face 13, in such a way that they protrude slightly beyond the maximum diameter of the bit body. For example, a typical drill bit having a nominal size of 6¼ inches will usually have a span of 6¼ inches between the most extreme right hand portion of an insert and the most extreme left hand portion of a diametrically opposite insert, whereas the maximum diameter of the body 12 would typically be about 6⅛ inches. With regard to the size and quantity of inserts 26, the largest size that is economically feasible should likely be employed, with it being understood that larger carbide inserts cost much more than smller ones. Yet, there must still be room left between some of the inserts to permit the rock face to be struck at widely spaced locations—in order to promote the fragmentation of relatively large rock chips. For most any bit, it is preferable that there be several substantial gaps between widely spaced inserts, with said gaps averaging about one-third of the nominal bit size. For example, in the bit diagramatically shown in FIG. 3, a bit having a nominal diameter of 6 inches has at least seven open gaps whose average length is about 2.3 inches. On a 6-inch bit, there will normally be about 12⅝ inserts and six or seven ½-inch inserts, with the larger inserts usually being located closer to the sides of the bit (where the tangential velocity of the rotating bit is greater that it is near its longitudinal axis). Also, there should be several hardened inserts 26 at the periphery of the face where the wear is likely to be much greater than it is near the center of the bit. As a quick "rule of thumb", it may be said that there should be one or more peripheral inserts for each inch of bit diameter. In the embodiment shown in FIG. 2, there are nine widely spaced peripheral inserts on a bit having a nominal diameter of about 6 inches.

Figure 4:
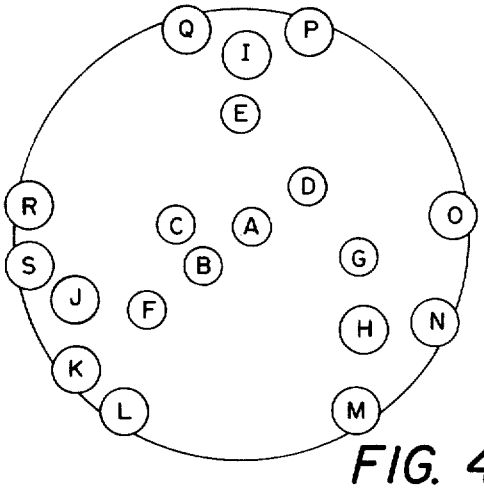
FIG. 4 is a diagramatic view of the top of a drill bit, showing a typical arrangement of a plurality of hardened inserts.

The radial spacing of the inserts 26 from the longitudinal axis of the body 12 is such that there is an overlap of the track or trace of each insert by the track of another insert, with such tracks being established by virtue of the body being rotated about its own longitudinal axis. This feature can perhaps best be illustrated by referring to FIGS. 4 and 5 which illustrate a representative placement of hardened inserts. That is, FIG. 4 shows a typical placement of a variety of hardened inserts on the face of a bit, with the letters A–S designating the location of various inserts. A reference to FIG. 5 will show that the size and distribution of the inserts are such that when the bit is rotated the track of insert A is partially overlapped by the track of insert B, and the track of insert B is, in turn, partially overlapped by the track of insert C, etc. Hence, according to this preferred placement of inserts, there will be no portion of the rock area underneath a drill bit that is not subject to being contacted by a hardened insert.

While referring generally to the distribution of the buttons 26 on the bit 10, it will perhaps be appropriate at this time to contrast the bit 10 with that shown in U.S. Pat. No. 3,583,504, to Aalund. That is, a bit made in accordance with the teachings of Aalund will have a significant surface portion which is disposed asymmetrically (i.e., inclined) with respect to the face of the bit, and a plurality of buttons will be disposed thereon for the avowed purpose of imparting a lateral component of motion to the bit as it is driven forward by a percussion hammer. In the bit of this invention, however, there is no need for the features taught by Aalund, since the positive relief on the sides 14 obviates the need for drilling a hole which is slightly larger than the bit diameter. That is, with a bit of this invention there is no need for a "wobble" or sideward action of the bit in the hole. It should be noted, also, that while the distribution of inserts 26 on the face 13 need not be uniform, in general there will be just about as many inserts on any one half of the face as there are on the other half—regardless of how a dividing line is established. Hence, the axial percussive blows imparted to the base of the bit 10 (through an anvil affixed to a longitudinal shank) should be manifested as relatively pure axial blows against the rock face.

The relief channels 20 on the face and the major side grooves 22 preferably are machined into the body 12 with a tool such as a "ball nose" end mill cutter, with the result that said channels and grooves will constitute substantially longitudinal sections of a cylinder. That is, a piece of cylindrical rod or tubing of appropriate diameter could be laid into a channel 20 or groove 22, and there should be uniform contact throughout the entire surface of said channel or groove. Too, it is preferred that the width of the major groove 22 (at least near the face 13) and the width of the relief channel 20 be about the same as the diameter of that cylinder which would define said grooves and/or channels. With regard to the extent of the spiral in the side grooves 22, it is preferred that the inclination of the spiral be sufficient that the grooves 22 would extend through an arc of approximately 120° in a groove length of about 10 inches. Of course, the body 12 need not even extend for 10 inches, but the inclination of the spiral is still adequately defined by the aforesaid relationship.

In addition to the major spiral grooves 22, it is also preferred that there be a plurality of relatively shallow grooves, hereinafter referred to as "minor" grooves 28, which extend spirally and rearwardly along the sides of the bit from a region near the face 13 to the base 16. Typically, there will be one minor groove 28 extending adjacent each of the major grooves 22 along the sides of the bit. One reason for providing these minor grooves is to foster the removal of any relatively small cuttings that may exist in the bottom of the hole, as well as to preclude the "packing" of cuttings that might occur along a smooth, uninterrupted surface at the sides of the bit. Of course, if the bit is very large, such that it has a substantial linear distance between any two major grooves 22, then there might be justification for providing two minor grooves 28 in the gap between two adjacent major grooves. While the cross-section of the minor grooves 28 may correspond with that of a longitudinal portion of a cylinder, the width of said minor grooves will typically be appreciably les than the diameter of such a cylinder; that is, said grooves can only be described as shallow if their depth is appreciably less than their width.

Referring again to FIG. 1, it will be apparent that the length of the drill bit 10 is substantially less than its diameter, and this will typically be a characteristic of bits made in accordance with the invention—because it is desirable that any rock chips which are knocked loose should be rapidly forced out of the active cutting area and into a passive area along the sides of and behind the bit. Another facet of the invention will be apparent from FIG. 1, namely, that the major and minor spiral grooves 22, 28 terminate just sightly ahead of the base 16. The diameter of the base 16 is established such that it is about the same but no less than the diameter of the hammer nut which constitutes a part of the percussion hammer which drives the bit into the hard rock.

Figure 5:
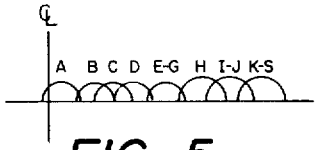
FIG. 5 is a drawing showing the radial spacing of the hardened inserts that appear in FIG. 4.
Figure 6:
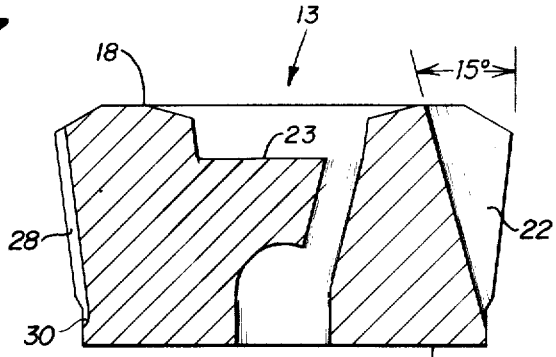
FIG. 6 is a cross-sectional view taken in the plane VI—VI in FIG. 2 but omitting the hardened inserts (for clarity)

Referring additionally to FIG. 6 (which is a cross sectional view of a typical bit), another facet of the invention will be readily apparent, namely, that the major groove 22 has a negative relief of about 15°, i.e., it slopes inwardly from the base 16 toward the face 13. Of course, the negative relief of the groove 22 should be added to the positive relief of the sides 14 to determine the total angle encompassed by the groove 22. When the sides are inclined 7° and the groove 22 is inclined 15° with respect to the longitudinal axis, a total angle of 22° is realized—and this contributes to a substantial depth for producing a significant "scooping" action on the rock chips. On the right side of FIG. 6 a major groove 22 has been illustrated, with said groove being rotated slightly in the drawing such that it lies in the same plane as the longitudinal axis of the bit. Similarly, on the left side of FIG. 5 a minor groove 28 has been illustrated, and it too has been rotated in this figure as if it was totally in a single plane which includes the longitudinal axis of the bit. At the point where the minor groove 28 approaches the base 16, an outwardly turned surface 30 is provided to insure that cuttings moving rearwardly through the groove 28 will be directed outwardly away from the hammer and toward the wall of the hole. Thus, both the major groove 22 and the minor groove 28 have a configuration which is designed to direct cuttings away from the relatively expensive percussion hammer and toward the walls of the hole.

Referring again to FIG. 2 another facet of the invention will now be treated, namely, that the size of the plurality of plateaus or lobes 28 is not uniform. In a typical bit for drilling, say, a 6¼ inch hole, the peripheral or arched distance between respective corners of a three-lobed bit would be, respectively, 4 inches and 3 inches. Even though the physical size of two plateaus 18 might be the same, the placement of the hardened inserts thereon would almost certainly be different—if the parameters established by FIGS. 4 and 5 are maintained. Hence, the configuration of each plateau 18 and its associated inserts 26 will typically be slightly different than the configuration of the others. Too, it should perhaps be noted that the preferred design for a bit of the invention includes a face which is divided by three relief channels 20 so as to provide three plateaus or lobes 18. It is believed that to provide only two plateaus would reduce the size of the scavaging surfaces (including the relief channels 20 and major grooves 22) which have been found to be so efffective in clearing cuttings from a hole. And, to provide four relief channels 20 and plateaus 18 could mean that each plateau might be so small as to be weakened by the notoriously severe loads which characterize the operation of a percussion bit. That is, a percussion hammer will typically operate with fluid at 175–250 psi with a down weight of 1500–2000 pounds, when a 6-inch bit is being utilized. The alternate raising and lowering of the hammer, which causes the anvil to be repetitively struck with substantial force, will inevitably tear apart a bit that does not have sufficient supporting structure to tolerate such blows from the hammer.

Figure 7:
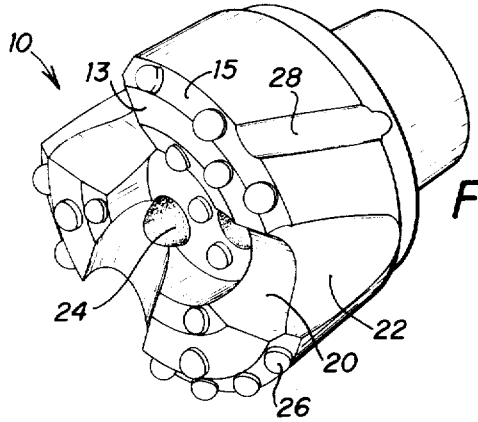
FIG. 7 is a perspective view of a drill bit of the invention.

In operation of the bit 10 shown in FIG. 7, the bit will typically be affixed to a percussion drill motor which is installed at the bottom end of a drill string. As drilling fluid (either liquid or gas) is supplied to the motor, the hammer thereof will repetitively strike the shank of the bit 10, driving it forward into the resisting rock. A rotary motion is also typically applied to the bit 10, such that the bit will rotate in the hole as well as move axially. After the bit rotates or indexes by a small increment, each of the plurality of discrete inserts 26 will come into contact with a new section of rock during the next axial blow. Eventually every portion of the rock face which underlies a bit could be contacted by one of the inserts A–S. Since the plateau portions of the bit are more forward than the other portions, they will effectively establish the depth of the bit in the hole, and the radial relief channels 22 will be separated from the bottom of the hole by a substantial distance; this distance and the drilling fluid facilitates the prompt removal of any cuttings from the hole, such that they do not remain where they would be ground into smaller chips if they should be struck again by the bit. In actual field tests, granite chips having a length of 2¼ inches, a width of 1¼ inches and a thickness of ⅝ inch have been routinely expelled from a hole being drilled with a 6-inch diameter bit. The substantial size of these chips can be favorably contrasted with typical cuttings generated by prior art bits—which chips average ¼ to ⅓ inch in size, with maybe only a few pieces having a ½ inch dimension. In granite quarries located near Bald Knob, Arkansas, the granite is so hard that it had been standard commercial practice to drill 10 feet with a prior art bit, and then pull the bit out of the hole to sharpen it—in order to maintain any sort of decent drilling rate. With a bit manufactured in accordance with FIGS. 1 and 2, two 30 foot holes were drilled in solid granite without stopping to "sharpen" the bit, i.e., grind away any worn sections in order to re-establish the original bit contour. At the conclusion of drilling the second 30 foot hole, the bit was removed from the hole and examined, and only negligible wear was visible. Hence, still additional holes could have been drilled without bothering to sharpen the bit.

The efficacy with which this bit can drill through hard structures is very definitely believed to stem from the cooperation of its several parts that foster the fragmentation of relatively large rock segments, followed by the rapid removal of said segments from the hole. Too, based on the amount of eventual wear that the body 12 will usually manifest, it is known that the major spiral grooves are contributing significantly to the removal of cuttings from the hole. That is, while the sides of the spiral grooves 22 on a new bit will typically intersect the sidewalls 14 at an angle of about 90°, after the bit has been used for many hours the intersection between said surfaces will be found to be rounded. A fair inference from this is that the major grooves 22 are actually *pushing* against cuttings, i.e., there is a significant rubbing action against said cuttings (rather than a mere channelization thereof). This pushing or "scooping" action is believed to be significantly improved by the spiral orientation of the grooves—as contrasted with grooves that might be parallel to the longitudinal axis of the bit. Also, the fact that rock chips are being directed outwardly away from the drill motor by the slope of the grooves 22 should contribute to a longer life for the relatively expensive drill motors.

While only the preferred embodiment of the invention has been disclosed in great detail herein, it will be apparent to those skilled in the art that modifications thereof can be made without departing from the spirit of the invention. Thus, the specific structure shown herein is intended to be exemplary and is not meant to be limiting, except as described in the claims appended hereto.

What is claimed is:

1. A percussion drill bit adapted for drilling particularly hard matter such as rock, comprising:

a. a substantially solid body having a relatively flat face at its forward end, and the face including a plurality of plateaus separated by radial relief channels, with the outer ends of said relief channels intersecting major spiral grooves extending along the sides of the bit, and the cross-sectional areas of said relief channels and the major grooves being approximately the same at their point of intersection, and the sides of said body constituting a frustrum of a cone having an included angle of about 14°, with the narrow portion of the cone being at the base of the body, and the face of said body further having a center portion which is recessed with respect to the plateau portions, and the major spiral grooves extending from the face to near the base and having a negative relief of about 15° from the base toward the face, whereby the movement of relatively large cuttings away from the face of the bit and along the major spiral grooves to the base thereof is fostered;

b. a plurality of flow passages extending through the body of the drill bit for the delivery of drilling fluid to the face of the bit, and said passages terminating on the face near either the relief channels or the recessed center; and c. a plurality of hardened inserts widely distributed across the face and protruding therefrom, and there being at least some hardened inserts distributed around the periphery of the face in such a way that they protrude slightly beyond the maximum diameter of the bit body.

2. The drill bit as claimed in claim 1 wherein the relief channels on the face and the major side grooves constitute substantially longitudinal sections of a cylinder, and the width of the major side grooves is approximately the same as the diameter of the cylinder that defines said grooves.

3. The drill bit as claimed in claim 1 wherein there are a plurality of wide gaps between pairs of hardened inserts, with one of the inserts of a given pair being on one plateau and the other insert being located across a relief channel and on the adjacent plateau, and the average distance of said gaps being about one-third of the nominal diameter of the bit.

4. The drill as claimed in claim 1 wherein the plateau portions of the face comprise about 50% of the total face area, such that a significant portion of the face area is available for expelling cuttings which are generated as a result of impacts by the plateau portions against a resisting structure.

5. The drill bit as claimed in claim 1 wherein the sides of the major spiral grooves intersect the side walls of the body at an angle of about 90°, whereby a significant "scooping" action on the rock chips is realized from rotating the bit in the hole and said chips are rapidly removed from the cutting area.

6. A percussion drill bit adapted for drilling particularly hard matter such as rock, comprising:

a. a substantially solid body having a relatively flat face at its forward end, and the face including three plateaus separated by three radial relief channels of substantial depth, with the outer ends of said relief channels intersecting major spiral grooves extending along the sides of the bit, and the cross-sectional areas of said relief channels and the major grooves being approximately the same at their intersection, and the sides of said body constituting a frustram of a cone, with the narrow portion of the cone being at the base of the body, and the face of said body further having a circular center portion which is recessed with respect to the plateaus, with the diameter of said center portion being about one-third of the diameter of said body;

b. a flow passage extending through the body of the drill bit for the delivery of drilling fluid to the face of the bit, and said passage terminating on the face within the recessed center;

c. a plurality of hardened inserts widely distributed across the face and protruding therefrom, with the radial spacing of said inserts with respect to the longitudinal axis of the body being such that there is an overlap of the tracks of each insert by the track of another insert as the body is rotated about its longitudinal axis, whereby there is essentially no portion of the rock area underneath a drill bit that is not subject to being contacted by a hardened insert; and d. a plurality of relatively shallow minor grooves extending spirally and rearwardly along the sides of the bit from a region near the face of the bit to the base thereof, with there being at least one minor groove extending adjacent each of the major grooves along the sides of the bit.

7. A percussion drill bit adapted for drilling particularly hard matter such as rock comprising:

a. a substantially solid body having a relatively flat face at its forward end, and the face including a plurality of plateaus separated by radial relief channels, with the outer ends of said relief channels intersecting major spiral grooves extending along the sides of the bit, and the cross-sectional areas of said relief channels and the major grooves being approximately the same at their point of intersection, and the sides of said body constituting a frustrum of a cone having an included angle of about 14°, with the narrow portion of the cone being at the base of the body, and the face of said body further having a center portion which is recessed with respect to the plateau portion;

b. a plurality of flow passages extending through the body of the drill bit for the delivery of drilling fluid to the face of the bit, and said passages terminating on the face near either the relief channels or the recessed center; and c. a plurality of hardened inserts widely distributed across the face and protruding therefrom, with the configuration of each plateau and its associated inserts being slightly different than the other plateaus and their associated inserts.

8. A percussion drill bit adapted for drilling particularly hard matter such as rock, comprising:

a. a substantially solid body having a relatively flat face at its forward end, and the face including a plurality of plateaus separated by radial relief channels, with the face of the bit being divided by three relief channels so as to provide three plateaus, and there being at least one of the plateaus with a size which is significantly different from the other plateaus, with the outer ends of said relief channels intersecting major spiral grooves extending along the sides of the bit, and the cross-sectional areas of said relief channels and the major grooves being approximately the same at their point of intersection, and the sides of said body constituting a frustrum of a cone having an included angle of about 14°, with the narrow portion of the cone being at the base of the body, and the face of said body further having a center portion which is recessed with respect to the plateau portions;

b. a plurality of flow passages extending through the body of the drill bit for the delivery of drilling fluid to the face of the bit, and said passages terminating on the face near either the relief channels or the recessed center; and c. a plurality of hardened inserts widely distributed across the face and protruding therefrom.

* * * * *